US005290026A

United States Patent [19]

Helmstaedter

[11] Patent Number: 5,290,026

[45] Date of Patent: Mar. 1, 1994

[54] UNDER STACKING MECHANISM AND METHOD

[75] Inventor: Maximillian Helmstaedter, Villingen, Fed. Rep. of Germany

[73] Assignee: GBR Systems Corp., Naples, Fla.

[21] Appl. No.: 979,240

[22] Filed: Nov. 20, 1992

[51] Int. Cl.[5] ..... B65H 31/08

[52] U.S. Cl. ..... 271/212

[58] Field of Search ..... 271/2, 198, 202, 212; 414/794.9

[56] References Cited

U.S. PATENT DOCUMENTS

| | | | |
|---|---|---|---|
| 2,933,313 | 4/1960 | Stobb | 271/202 |
| 3,379,432 | 4/1968 | Rüth | 271/2 |
| 3,671,034 | 6/1972 | de Ridder | 271/212 |
| 3,692,304 | 9/1972 | de Ridder | 271/212 |
| 4,369,959 | 1/1983 | Hornbuckle | 271/212 |
| 4,526,362 | 7/1985 | Thierstein | 271/212 |
| 4,640,506 | 2/1987 | Luperti et al. | 271/212 |
| 4,657,237 | 4/1987 | Hänsch | 271/202 |
| 4,762,314 | 8/1988 | Harada | 271/212 |
| 4,786,040 | 11/1988 | Thomsen | 271/212 |
| 4,805,891 | 2/1989 | Luperti et al. | 271/212 |
| 4,810,153 | 3/1989 | Armelin | 414/794.9 |
| 4,867,435 | 9/1989 | Cogswell et al. | 271/202 |
| 5,026,340 | 6/1991 | Thompson | 271/2 |
| 5,054,760 | 10/1991 | Reist | 271/198 |
| 5,123,639 | 6/1992 | Edwards | 271/212 |

FOREIGN PATENT DOCUMENTS

| | | | |
|---|---|---|---|
| 503711 | 7/1930 | Fed. Rep. of Germany | 271/198 |
| 226856 | 9/1985 | German Democratic Rep. | 271/198 |
| 227116 | 9/1985 | German Democratic Rep. | 271/198 |

*Primary Examiner*—David H. Bollinger
*Attorney, Agent, or Firm*—Stoll, Miskin, Previto & Hoffman

[57] ABSTRACT

A mechanism for handling packages having mechanism to move a package from a depositing station to a removing station. The packages comprise a preceding package and a subsequent package with the preceding package being deposited on the moving mechanism before the subsequent package and the subsequent package being deposited on said moving mechanism under said preceding package.

3 Claims, 1 Drawing Sheet

UNDER STACKING MECHANISM AND METHOD

BACKGROUND

The present invention is directed to a mailer operation and more particularly to an improved stacking arrangement and method for such mailer operations.

Normally, in handling large numbers of papers, the papers are formed into a package and the package is delivered to a stacking table which then takes the packages and directs them to a predetermined destination such as a stacking tray. Stacking of such packages has normally been accomplished by stacking one package over the other and continuing to stack one package over the other as each package is completed and delivered to the stacking tray. In other words, after a package is formed and exits from the folder mechanism, it is placed on top of another package on a shingling exit conveyor. This sometimes creates space problems and also proper sealing problems where a letter, for example, may not be completely closed and the glue may dry before it fully seals the letter. In addition, when the packages are stored in trays it sometimes becomes necessary to invert the stacked packages in order to present the packages in the order in which they were processed.

OBJECTS

The present invention avoids these drawbacks and has for one of its objects improved means and method for stacking packages which ensure that a package is properly stacked.

Another object of the present invention is the provision of an improved package stacking mechanism and method in which the glue will automatically be pressed down so that it seals the package before the package is moved out of the machine.

Another object of the present invention is the provision of an improved method and means in which the packages are understacked.

Another object of the present invention is the provision of an improved method and means for stacking packages in which the packages are placed in a tray in the same order in which they are processed.

Other and further objects of the invention will be obvious upon an understanding of the illustrative embodiment about to be described, or will be indicated in the appended claims and various advantages not referred to herein will occur to one skilled in the art upon employment of the invention in practice.

In accordance with the present invention, packages are fed from a folder to an exit conveyor. Each package fed is placed under the previously fed package so that stacking of the packages occurs from the bottom up. In order to accomplish this, the packages are fed to tilting mechanism, such as a glide strip mechanism, before being fed to the exit conveyor. The glide strip mechanism keeps the rear edge of the package lifted in order to permit another package to be placed under that previously fed package.

DRAWINGS

A preferred embodiment of the invention has been chosen for purposes of illustration and description and is shown in the accompanying drawings forming a part of the specification, wherein.

DESCRIPTION

Figure 1:
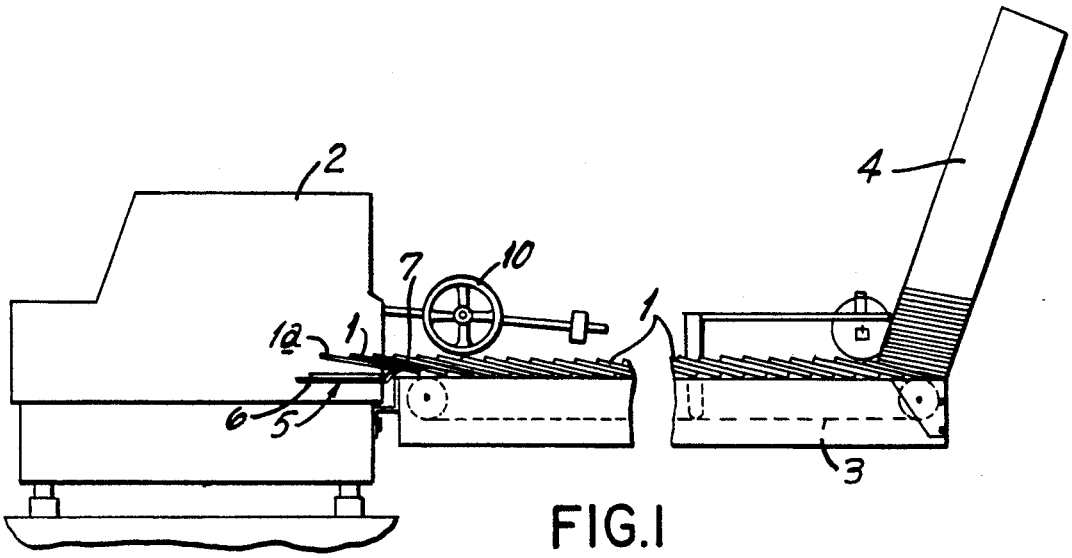
FIG. 1 is a diagramatic view of a mechanism for stacking packages showing the manner of stacking them in accordance with the present invention.

Referring to the drawings, packages 1, such as envelopes stuffed with documents, are processed by a processing mechanism, such as a folder mechanism 2, which may be any standard or well-known folder mechanism. The packages 1 are fed from the folder mechanism 2 (deposing means) onto a paper feed exit conveyor 3 (moving means) which directs the packages 1 to another tray 4 (moving means).

Under ordinary circumstances, a package 1 would be deposited on the conveyor 3 and a subsequent package 1*a* would be deposited on top of the first package 1. In accordance with the present invention, the first package 1 is deposited on the conveyor 3 and the package 1*a* immediately following it is deposited under the rear edge 1R of the first package 1. Each new package 1*a* is deposited under the rear edge 1F of the previously deposited package 1 on the conveyor 3 so that as they move along the conveyor 3, the shingled packages 1 and 1*a* will reach the stacking tray 4 at the end of the conveyor 3. At this point, they are inserted into the stacking tray 4, one on top of another, as soon as they reach the stacking tray.

The preferred understacking mechanism of the present invention is shown in the drawings. In this connection, a tilting mechanism, in the form of a glide strip 5, is provided rearwardly of the conveyor 3. The glide strip 5 has a flat planar portion 6 and an upwardly angled front portion 7. A package 1 leaving the folder mechanism 2 is deposited by any well known feed mechanism (not shown) onto the rear flat planar portion 6 of the glide strip 5. The package 1 continues to move over the glide strip 5 until its front edge 1F is moved up by the angled front part 7. As the package 1 continues to move along, it is raised and moved over the front angled portion 7 of the glide strip 5 until the rear portion 1R of the package 1 is lifted by the front angled portion 7 while the forward end 1F of the package 1 rests on the exit conveyor 3.

Figure 2:
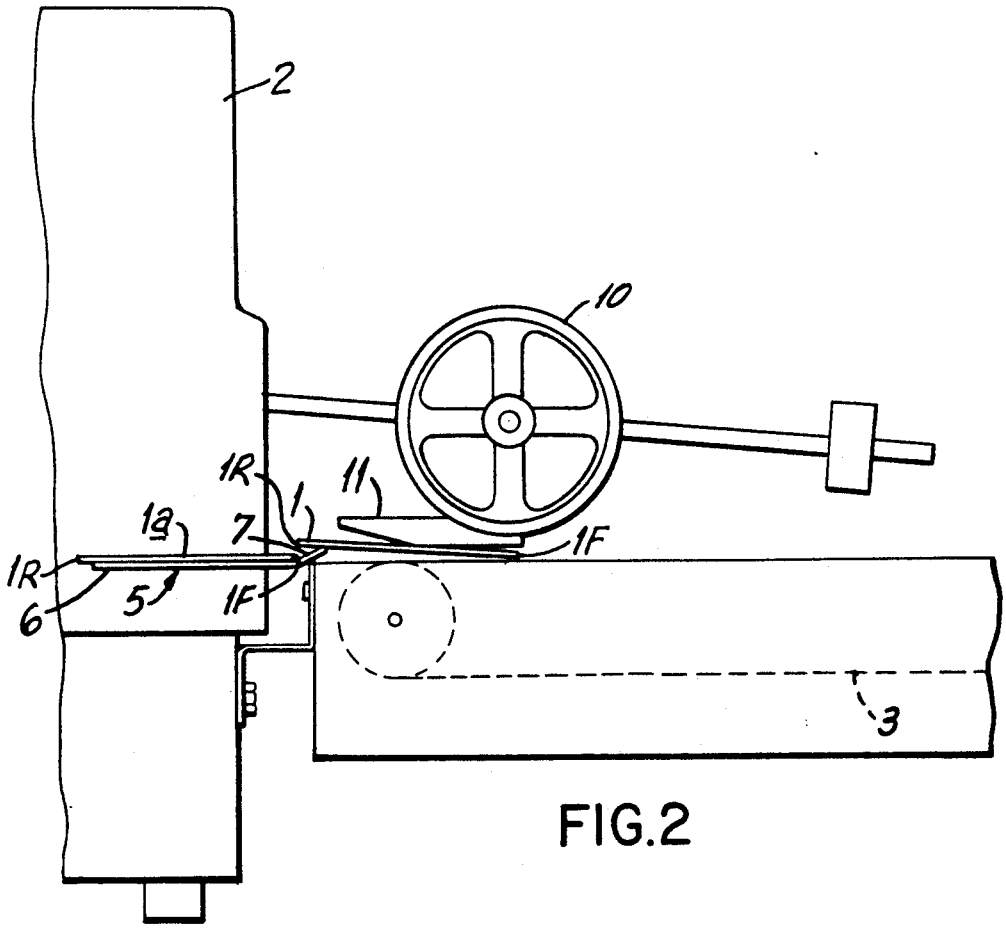
FIG. 2 is a diagramatic view of a detail of the stacking mechanism of the present invention.

As shown in FIG. 2, a holddown mechanism 10 may be provided in the form of a wheel 10 with a hold down foot 11 to hold the forward part 1F of the package down so that the front 1F of the package 1 rests on the exit conveyor 3 and the rear portion 1R of the package 1 is uplifted by the upwardly angled front portion 7 of the glide strip 5. In this position, the paper feed from the folder 2 will move a second package 1*a* underneath the rear edge 1R of the first package 1. As the exit conveyor 3 is moved along, each previously fed package 1 has a succeeding package 1*a* placed under its rear edge 1R. As this continues, all of the packages 1 and 1*a* are thereby understacked as shown in FIG. 1 so that they may be easily fed, one by one, neatly into the stacker tray 4 in the order in which they are processed.

It will be seen that the present invention provides improved means and method for stacking packages which ensure that a package is properly stacked, in which the glue will automatically be pressed down so that it seals the package before the package is moved out of the machine, in which the packages are understacked and in which the packages are placed in a tray in the same order in which they are processed.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mechanism for handling packages including package moving means (3), means (2) for depositing a package on said moving means, means (4) for removing a package from said moving means, said moving means adapted to move a package from the depositing means to the removing means, said packages comprising a preceding package and a subsequent package, said depositing means adapted to deposit the preceding package on said moving means, said subsequent package being deposited on said moving means, means for depositing said subsequent package on the moving means under said preceding package, means are provided to maintain a portion of said preceding package in an uplifted position to permit the subsequent package to be placed under the uplifted portion of the preceding package, each of said packages have a rear end and a front end and wherein said maintaining means comprises means for tilting the rear end of the preceding package upwardly in order to permit the front end of the subsequent package to be placed under the said rear end of the preceding package, the tilting means tilts the rear end of said preceding package to permit the front end of the preceding package to rest on the moving means while the said rear end of the preceding package is tilted upwardly, said tilting means comprises a glide strip having a body portion and a forward upwardly directed tilting portion, and where the body portion of the glide strip is planar with the moving means and the upwardly directed tilting portion is above the plane of the body portion.

2. A mechanism as set forth in claim 1 wherein said packages are comprised of at least one sheet.

3. A mechanism as set forth in claim 2 wherein said packages are adapted to be placed in a stacker after they leave the moving means.

* * * * *